US010415275B2

(12) United States Patent
Byun et al.

(10) Patent No.: US 10,415,275 B2
(45) Date of Patent: Sep. 17, 2019

(54) TRUNK LATCH MODULE FOR VEHICLE

(71) Applicants: Hyundai Motor Company, Seoul (KR); Pyeong Hwa Automotive Co., Ltd., Daegu (KR)

(72) Inventors: Min Hyung Byun, Seoul (KR); Yong Hyuck Im, Seoul (KR); Mun Bae Tak, Daegu (KR)

(73) Assignees: Hyundai Motor Company, Seoul (KR); Pyeong Hwa Automotive Co., Ltd., Daegu (KR)

( * ) Notice: Subject to any disclaimer, the term of this patent is extended or adjusted under 35 U.S.C. 154(b) by 314 days.

(21) Appl. No.: 15/372,237

(22) Filed: Dec. 7, 2016

(65) Prior Publication Data

US 2017/0298661 A1 Oct. 19, 2017

(30) Foreign Application Priority Data

Apr. 15, 2016 (KR) ..... 10-2016-0046139

(51) Int. Cl.
*E05B 81/20* (2014.01)
*E05B 83/18* (2014.01)
(Continued)

(52) U.S. Cl.
CPC ..... *E05B 81/20* (2013.01); *E05B 81/06* (2013.01); *E05B 81/16* (2013.01); *E05B 81/30* (2013.01);
(Continued)

(58) Field of Classification Search
CPC ..... Y10T 292/1082; Y10T 292/1047; E05B 81/20; E05B 81/06; E05B 81/16;
(Continued)

(56) References Cited

U.S. PATENT DOCUMENTS 4,518,180 A * 5/1985 Kleefeldt ..... E05B 81/06 292/201
4,892,339 A * 1/1990 Kleefeldt ..... E05B 81/20 292/201
(Continued)

FOREIGN PATENT DOCUMENTS

JP 2739677 B2 4/1998
JP 2008-13932 A 1/2008
(Continued)

*Primary Examiner* — Alyson M Merlino
(74) *Attorney, Agent, or Firm* — Morgan, Lewis & Bockius LLP

(57) ABSTRACT

A trunk latch module for a vehicle may include a base plate, a first locking groove for insertion of a striker into the first locking groove, a main gear rotatably combined with the base plate at a position above the first locking groove, the main gear being supplied with power of a motor, a claw rotatably combined with the base plate, with a second locking groove provided at a first end of the claw, and with a stop protrusion provided on an outer surface of a second end of the claw, a link assembly combined with the main gear, the link assembly transmitting power to the claw by operating in conjunction with rotation of the main gear, a claw-locking assembly locking or releasing the claw by using power transmitted from the link assembly, and a guide lever guiding rotation directions of the link assembly and the claw-locking assembly.

11 Claims, 11 Drawing Sheets

(51) Int. Cl.

| | |
|---|---|
| ***E05B 81/66*** | (2014.01) |
| ***E05B 81/90*** | (2014.01) |
| ***E05B 81/06*** | (2014.01) |
| ***E05B 81/16*** | (2014.01) |
| ***E05B 81/30*** | (2014.01) |
| ***E05B 81/74*** | (2014.01) |
| *E05B 81/04* | (2014.01) |

(52) U.S. Cl.
CPC ..... *E05B 81/66* (2013.01); *E05B 81/74* (2013.01); *E05B 81/90* (2013.01); *E05B 83/18* (2013.01); *E05B 81/04* (2013.01)

(58) Field of Classification Search
CPC ..... E05B 81/30; E05B 81/66; E05B 81/68; E05B 81/74; E05B 81/90; E05B 81/04; E05B 83/18; Y10S 292/29; Y10S 292/42; Y10S 292/23; Y10S 292/65; Y10S 292/43
See application file for complete search history.

(56) References Cited

U.S. PATENT DOCUMENTS

| | | | | | |
|---|---|---|---|---|---|
| 5,423,582 | A * | 6/1995 | Kleefeldt | E05B 81/20 | 292/201 |
| 5,765,884 | A * | 6/1998 | Armbruster | E05B 81/20 | 292/1 |
| 6,422,615 | B1 * | 7/2002 | Roos | E05B 81/20 | 292/201 |
| 2003/0218340 | A1 * | 11/2003 | Coleman | E05B 81/14 | 292/169.11 |
| 2006/0284425 | A1 | 12/2006 | Torka et al. | | |
| 2012/0091740 | A1 * | 4/2012 | Chevalier | E05B 81/20 | 292/226 |
| 2017/0328092 | A1 * | 11/2017 | Im | E05B 81/16 | |
| 2018/0073284 | A1 * | 3/2018 | Im | E05B 81/06 | |
| 2018/0171677 | A1 * | 6/2018 | Im | E05B 81/06 | |
| 2018/0171679 | A1 * | 6/2018 | Im | E05B 81/20 | |

FOREIGN PATENT DOCUMENTS

| | | | | |
|---|---|---|---|---|
| JP | 2009-249836 | A | 10/2009 | |
| KR | 10-2004-0098934 | A | 11/2004 | |
| KR | 10-2014-0010123 | A | 1/2014 | |
| KR | 10-2016-0052289 | A | 5/2016 | |
| KR | 10-2016-0053468 | A | 5/2016 | |
| KR | 10-2016-0098931 | A | 8/2016 | |
| WO | WO 2012/119581 | A2 | 9/2012 | |
| WO | WO-2018030556 | A2 * | 2/2018 | E05B 81/06 |

* cited by examiner

TRUNK LATCH MODULE FOR VEHICLE

CROSS REFERENCE TO RELATED APPLICATION

The present application claims priority to Korean Patent Application No. 10-2016-0046139, filed Apr. 15, 2016, the entire contents of which is incorporated herein for all purposes by this reference.

BACKGROUND OF THE INVENTION

Field of the Invention

The present invention relates generally to a trunk latch module for a vehicle, the trunk latch module being capable of locking and unlocking a trunk by use of a singular motor.

Description of Related Art

Generally, a vehicle is provided with the following: a trunk door through which objects are loaded into and unloaded out of a trunk; doors through which a user of the vehicle gets into and out of the vehicle, and a hood through which an engine room is accessed. Each door is provided with a latch with which a striker is engaged and disengaged.

For a trunk latch installed to lock and unlock a trunk, when a user of a vehicle does not apply a sufficient force to the trunk so as to lock the trunk, the user can normally determine whether the trunk is locked or unlocked via a signal of a dashboard after the user sits in a driver's seat. Accordingly, in the case when the trunk is not locked, the user has to exit the vehicle to lock the trunk, which is inconvenient. To solve this problem, a power trunk latch has been developed, in which the power trunk latch enables a trunk to be locked via a motor.

However, the power trunk latch according to the related art requires two motors that transmit power from respective directions so as to lock and unlock the trunk. Such a power mechanism excessively increases a volume of the power trunk latch, and thus the power trunk latch has many difficulties in being mounted in a vehicle body.

The information disclosed in this Background of the Invention section is only for enhancement of understanding of the general background of the invention and should not be taken as an acknowledgement or any form of suggestion that this information forms the prior art already known to a person skilled in the art.

BRIEF SUMMARY

Various aspects of the present invention are directed to providing a trunk latch module for a vehicle, in which locking, unlocking, and emergency unlocking of a trunk latch can be performed using a single motor.

According to various aspects of the present invention, a trunk latch module for a vehicle may include a base plate, a first locking groove formed by being depressed from a lower end of the base plate toward a middle of the base plate for insertion of a striker into the first locking groove, a main gear rotatably combined with the base plate at a position above the first locking groove, the main gear being supplied with power of a motor, a claw rotatably combined with the base plate at a middle thereof on a first side of the first locking groove relative to the first locking groove, with a second locking groove provided at a first end of the claw by being depressed toward the middle of the claw to correspond to an entering position of the striker, and with a stop protrusion assembly provided on an outer surface of a second end of the claw, a link assembly combined with the main gear, the link assembly transmitting power to the claw by operating in conjunction with rotation of the main gear, a claw-locking assembly locking or releasing the claw by using power transmitted from the link assembly, and a guide lever guiding rotation directions of the link assembly and the claw-locking assembly, in which as the main gear rotates in a first direction by the power of the motor, the link assembly and the claw-locking assembly may be stopped by the stop protrusion assembly of the claw, thereby locking the claw, and as the main gear rotates in a second direction, the link assembly and the claw-locking assembly may be released from the stop protrusion assembly, thereby unlocking the claw.

The motor may be combined with the main gear through a worm and a worm gear to transmit the power of the motor.

The stop protrusion assembly of the claw may include a first stop protrusion, a second stop protrusion, and a third stop protrusion.

The link assembly may include a first link mounted to the main gear while crossing the main gear, the first link operating in conjunction with the main gear during the rotation of the main gear, and a second link hinged to a second end of the first link at a first end of the second link, with a slit protrusion provided at a second end of the second link.

The claw-locking assembly may include a cancel lever rotatably combined with the base plate at a first end of the cancel lever at a first side of the first locking groove, with an extension part extending by protruding from a middle of the cancel lever toward a second side of the first locking groove, and a pawl lever including a first lever being in contact with the claw and a second lever being in contact with the link assembly and moving in conjunction with the cancel lever with a connection part of the first lever and the second lever coupled to be rotatable coaxially with the cancel lever.

The guide lever may be provided at a first end thereof with a guide protrusion configured to move along the extension part of the cancel lever, and may be provided at a middle thereof with a first slit hole into which the slit protrusion of the second link is inserted to guide a moving direction of the slit protrusion, and may be provided with a second slit hole at a second end of the guide lever, the second slit hole capable of moving along a rotation shaft of the claw while the guide lever rotates relative to the rotation shaft of the claw.

When the striker is inserted into the first locking groove, the striker may rotate the claw by pushing the third stop protrusion of the claw, and the second locking groove may block the first locking groove, to complete a first-level locking.

When the first-level locking is completed, the second end of the second link may be positioned to be stopped by the first stop protrusion, and the pawl lever may reach a position of the second stop protrusion.

When the main gear rotates counterclockwise, the second end of the second link may rotate the claw clockwise by pushing the first stop protrusion of the claw until the pawl lever is stopped by the third stop protrusion, thereby completing a second-level locking.

When the main gear rotates clockwise, a hinge connection part of the first link and the second link may rotate the cancel lever counterclockwise, and the pawl lever may rotate counterclockwise in conjunction with the counterclockwise rotation of the cancel lever, and may be released from the third stop protrusion, thereby unlocking the claw.

The trunk latch module may further include a controller to detect a first-level locked state by using a first sensor mounted to the cancel lever, rotate the main gear counterclockwise by controlling an operation of the motor, detect the completion of the second-level locking by using a second sensor provided on the base plate at a position adjacent to the claw, and rotate the main gear clockwise by using a third sensor provided on an upper end of the main gear, to allow the second end of the second link to reach the position of the second stop protrusion of the claw.

The cancel lever may be rotated counterclockwise by a force applied to a second end of the cancel lever so as to release the pawl lever from the third stop protrusion, so that an emergency unlock function may be performed.

The pawl lever may further include a third lever extending from an end of the second lever and bending opposite to the extension part of the cancel lever. When the main gear rotates counterclockwise, the hinge connection part of the first link and the second link may rotate the cancel lever counterclockwise by pressing down the third lever, and the pawl lever may rotate counterclockwise in conjunction with the counterclockwise rotation of the cancel lever and may be released from the third stop protrusion, thereby unlocking the claw.

As mentioned above, the trunk latch module for a vehicle according to various embodiments of the present invention can perform locking and unlocking of a trunk by using a single motor, thereby reducing the amount of space required for installation and thus being easily mounted in a vehicle body.

It is understood that the term "vehicle" or "vehicular" or other similar terms as used herein is inclusive of motor vehicles in general such as passenger automobiles including sports utility vehicles (SUV), buses, trucks, various commercial vehicles, watercraft including a variety of boats and ships, aircraft, and the like, and includes hybrid vehicles, electric vehicles, plug-in hybrid electric vehicles, hydrogen-powered vehicles and other alternative fuel vehicles (e.g., fuel derived from resources other than petroleum). As referred to herein, a hybrid vehicle is a vehicle that has two or more sources of power, for example, both gasoline-powered and electric-powered vehicles.

The methods and apparatuses of the present invention have other features and advantages which will be apparent from or are set forth in more detail in the accompanying drawings, which are incorporated herein, and the following Detailed Description, which together serve to explain certain principles of the present invention.

It should be understood that the appended drawings are not necessarily to scale, presenting a somewhat simplified representation of various features illustrative of the basic principles of the invention. The specific design features of the present invention as disclosed herein, including, for example, specific dimensions, orientations, locations, and shapes will be determined in part by the particular intended application and use environment.

DETAILED DESCRIPTION

Reference will now be made in detail to various embodiments of the present invention(s), examples of which are illustrated in the accompanying drawings and described below. While the invention(s) will be described in conjunction with exemplary embodiments, it will be understood that the present description is not intended to limit the invention(s) to those exemplary embodiments. On the contrary, the invention(s) is/are intended to cover not only the exemplary embodiments, but also various alternatives, modifications, equivalents and other embodiments, which may be included within the spirit and scope of the invention as defined by the appended claims.

Figure 1:
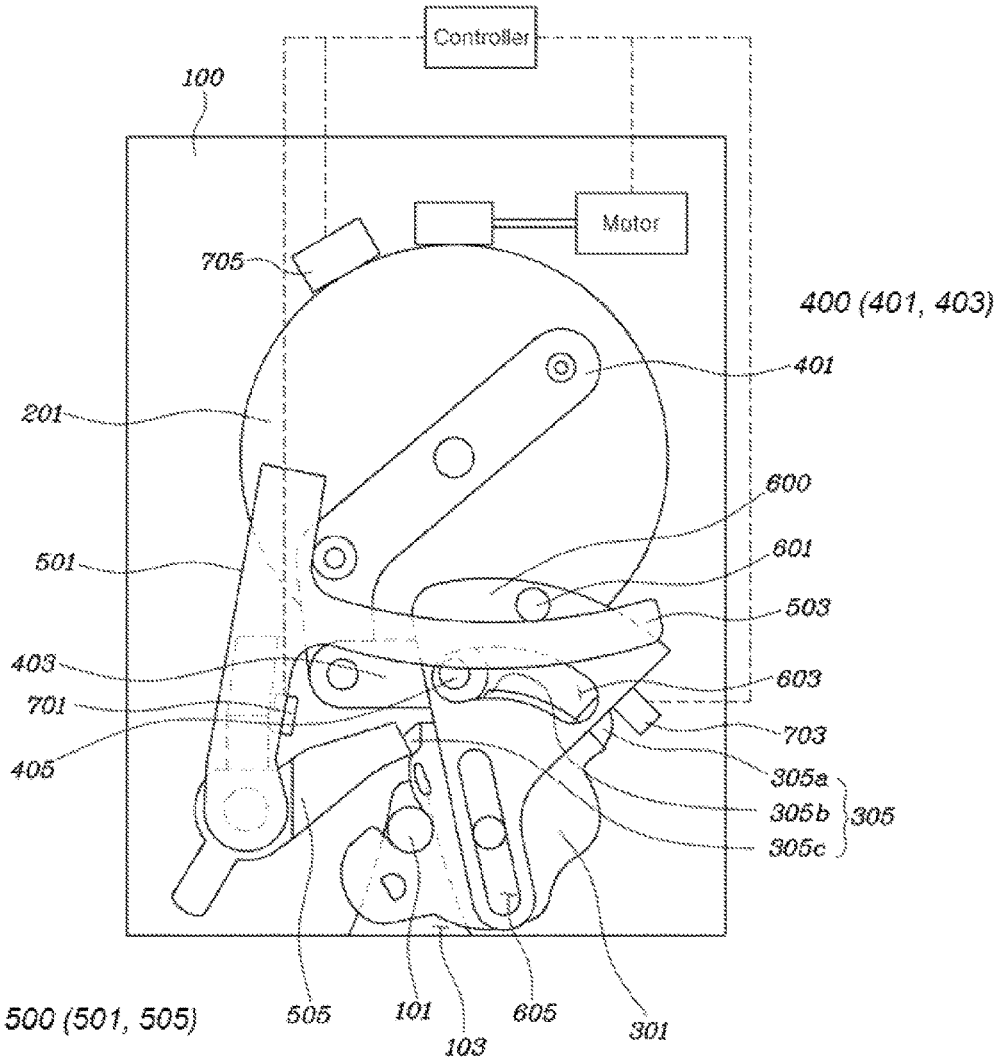
FIG. 1 is a top plan view of a trunk latch module for a vehicle according to various embodiments of the present invention.
Figure 2A:
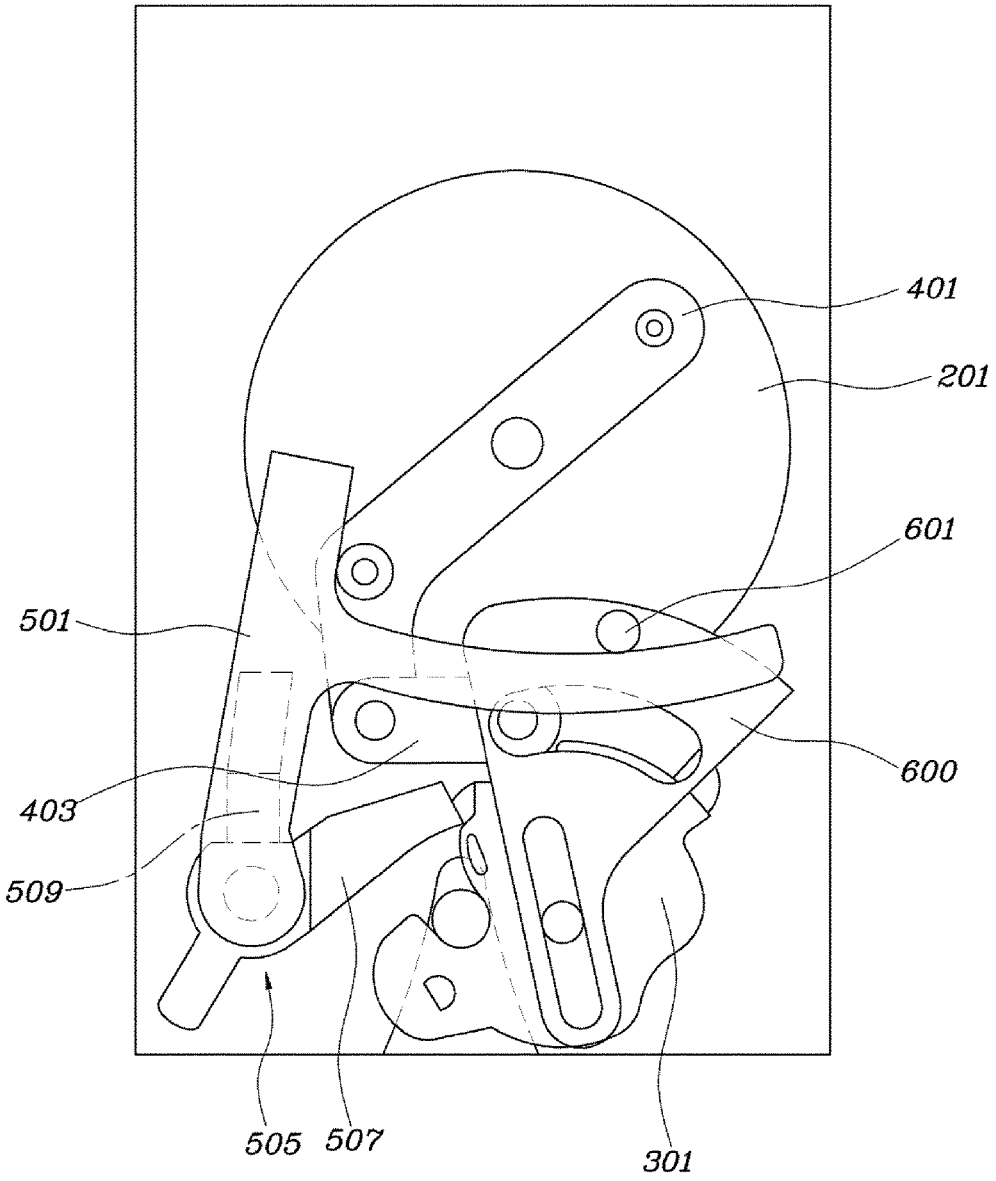
FIG. 2A, FIG. 2B, and FIG. 2C are top plan views that show unlocking operation processes of the trunk latch module for a vehicle according to various embodiments of the present invention.
Figure 2B:
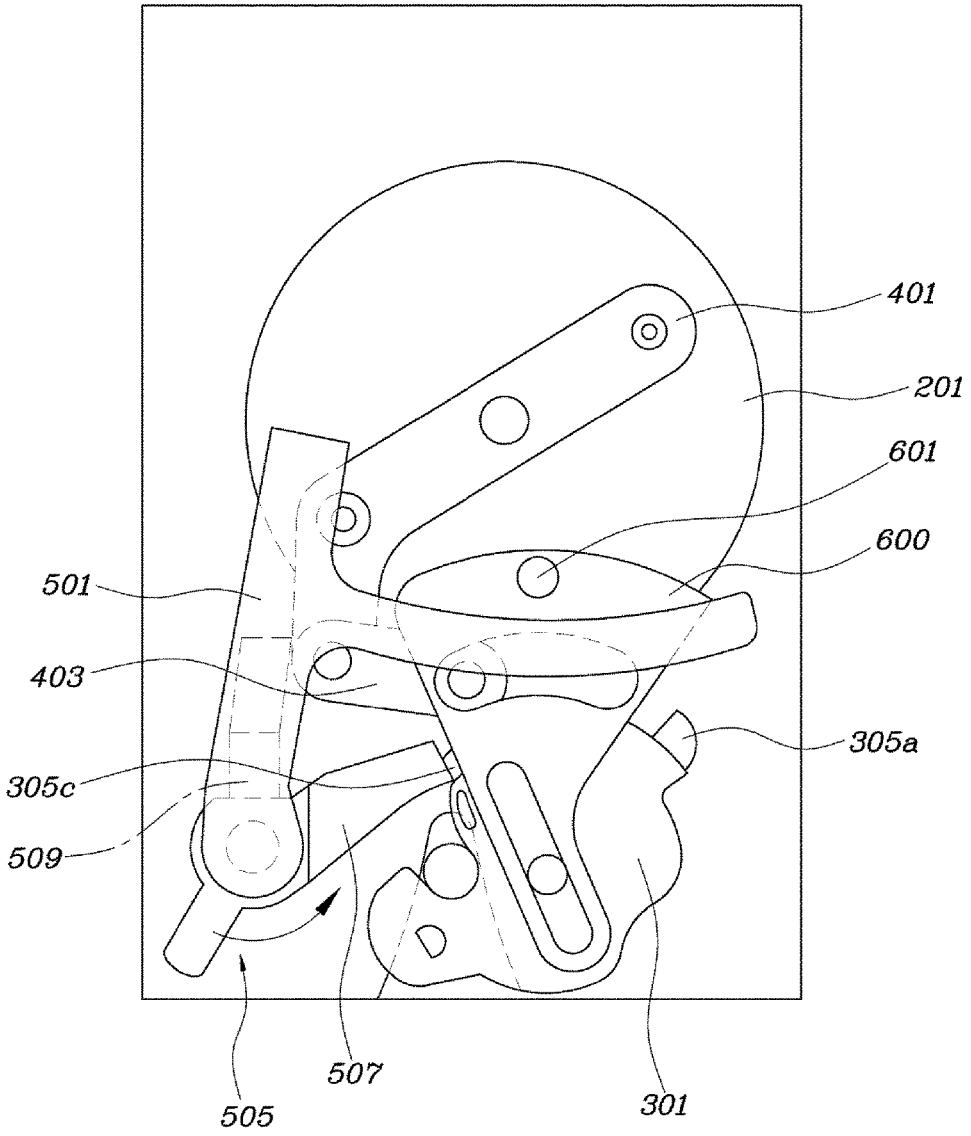
Figure 2C:
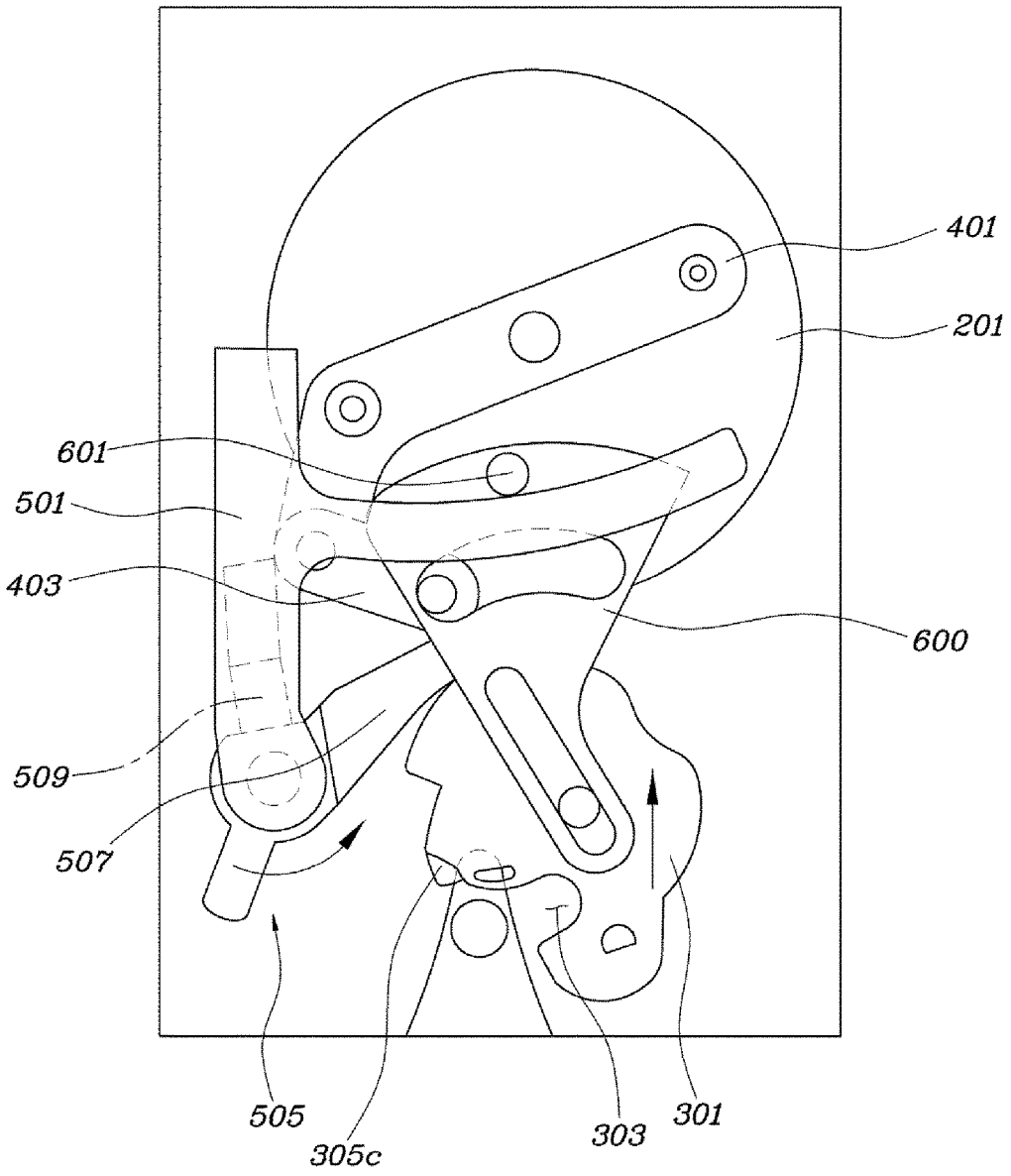
Figure 3A:
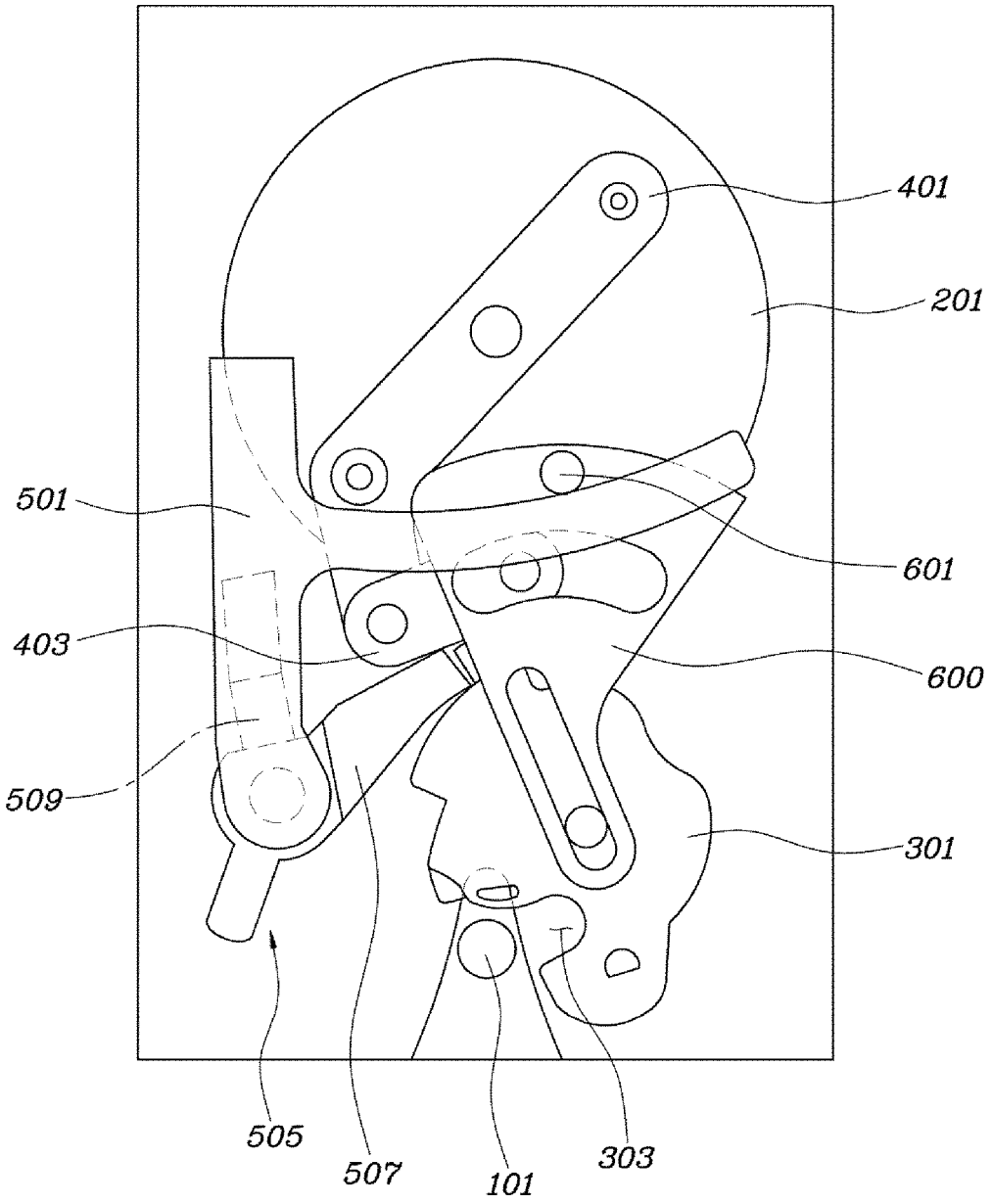
FIG. 3A, FIG. 3B, and FIG. 3C are top plan views that show locking operation processes of the trunk latch module for a vehicle according to various embodiments of the present invention.
Figure 3B:
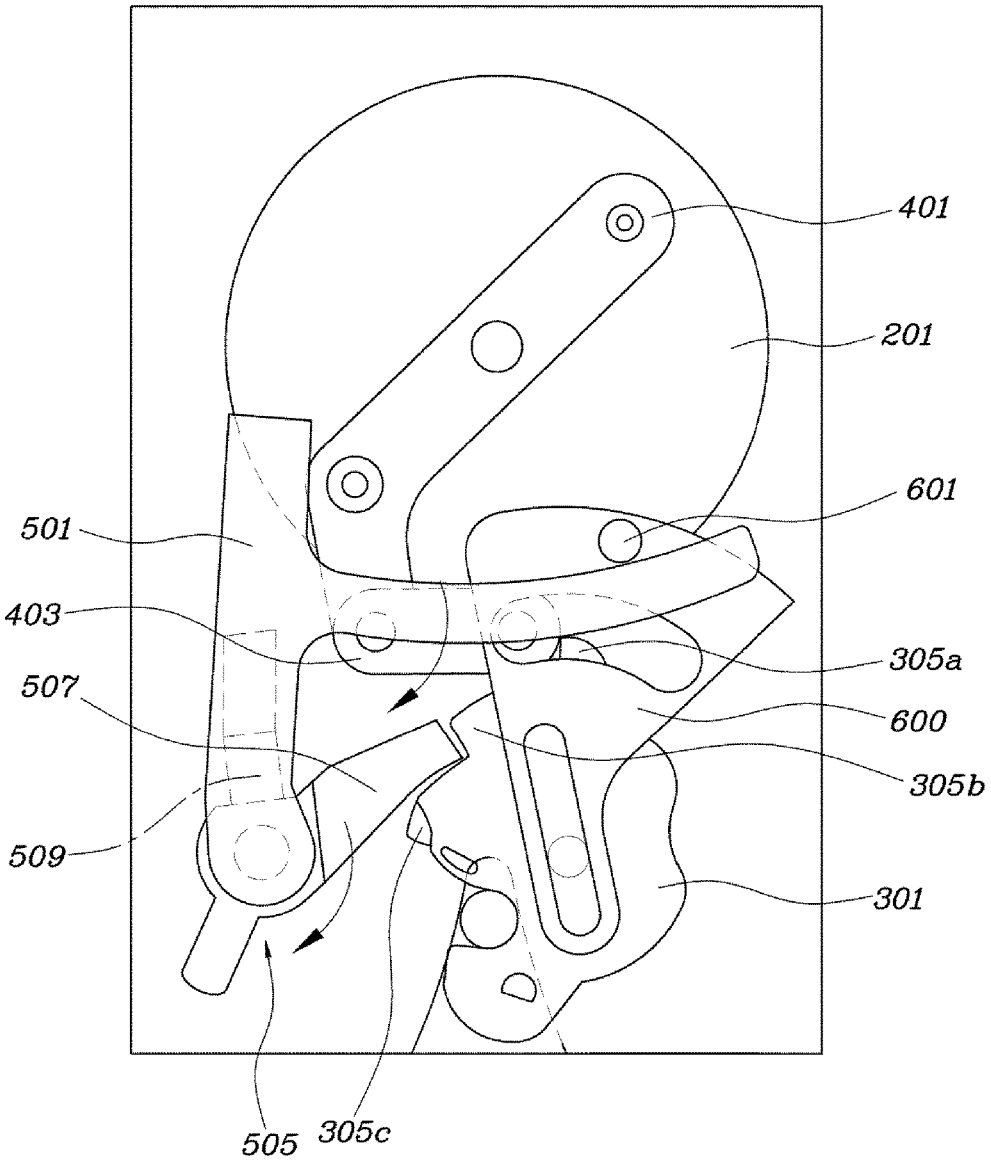
Figure 3C:
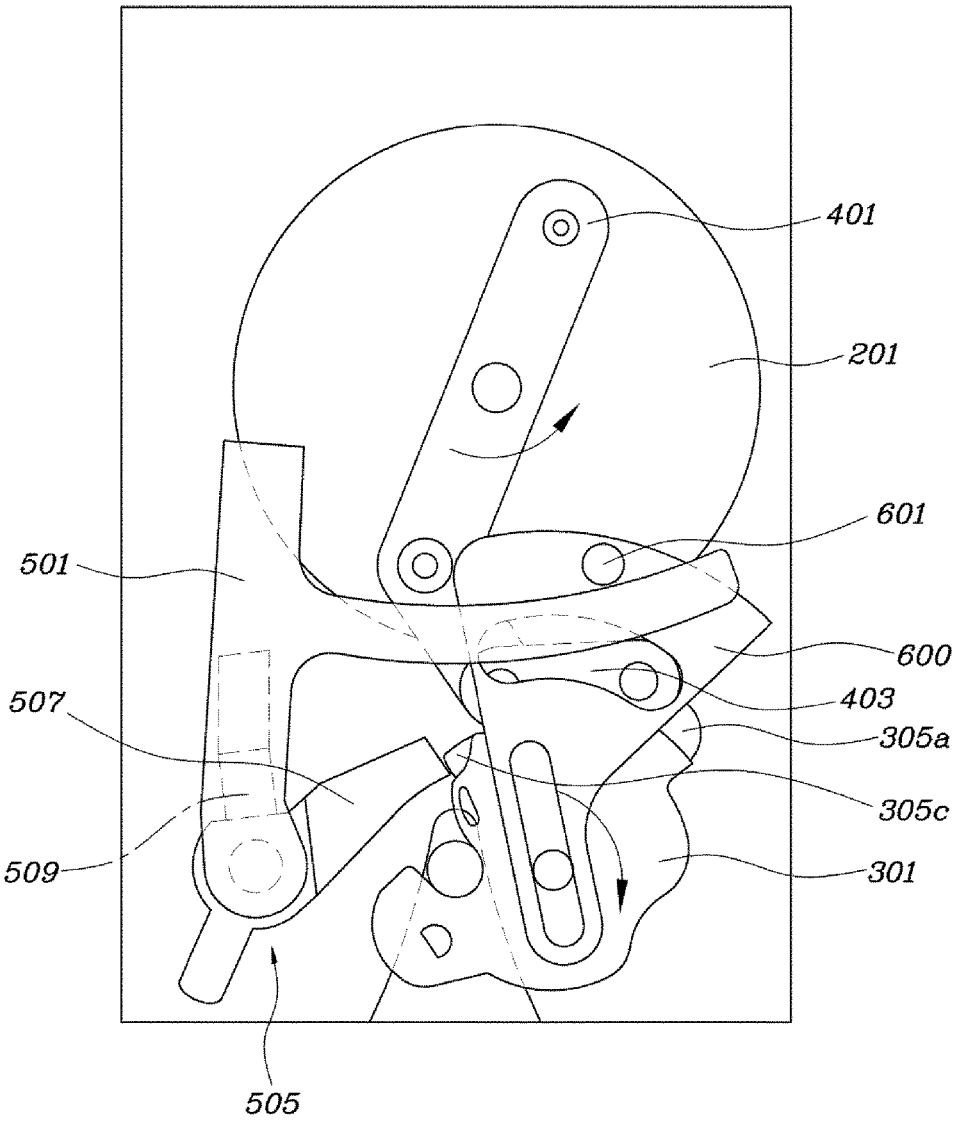
Figure 4A:
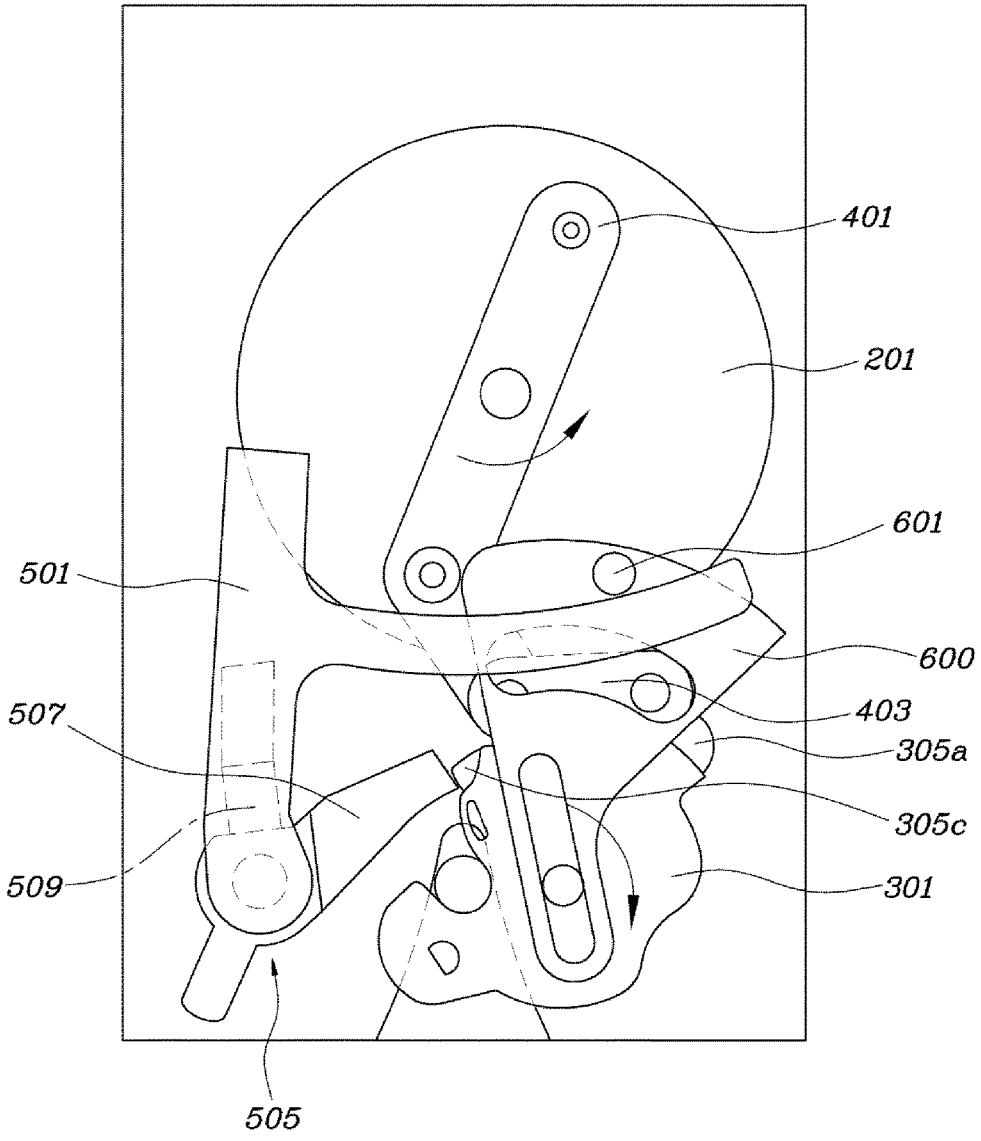
FIG. 4A and FIG. 4B are top plan views showing operation processes of an emergency unlock function of the trunk latch module for a vehicle according to various embodiments of the present invention.
Figure 4B:
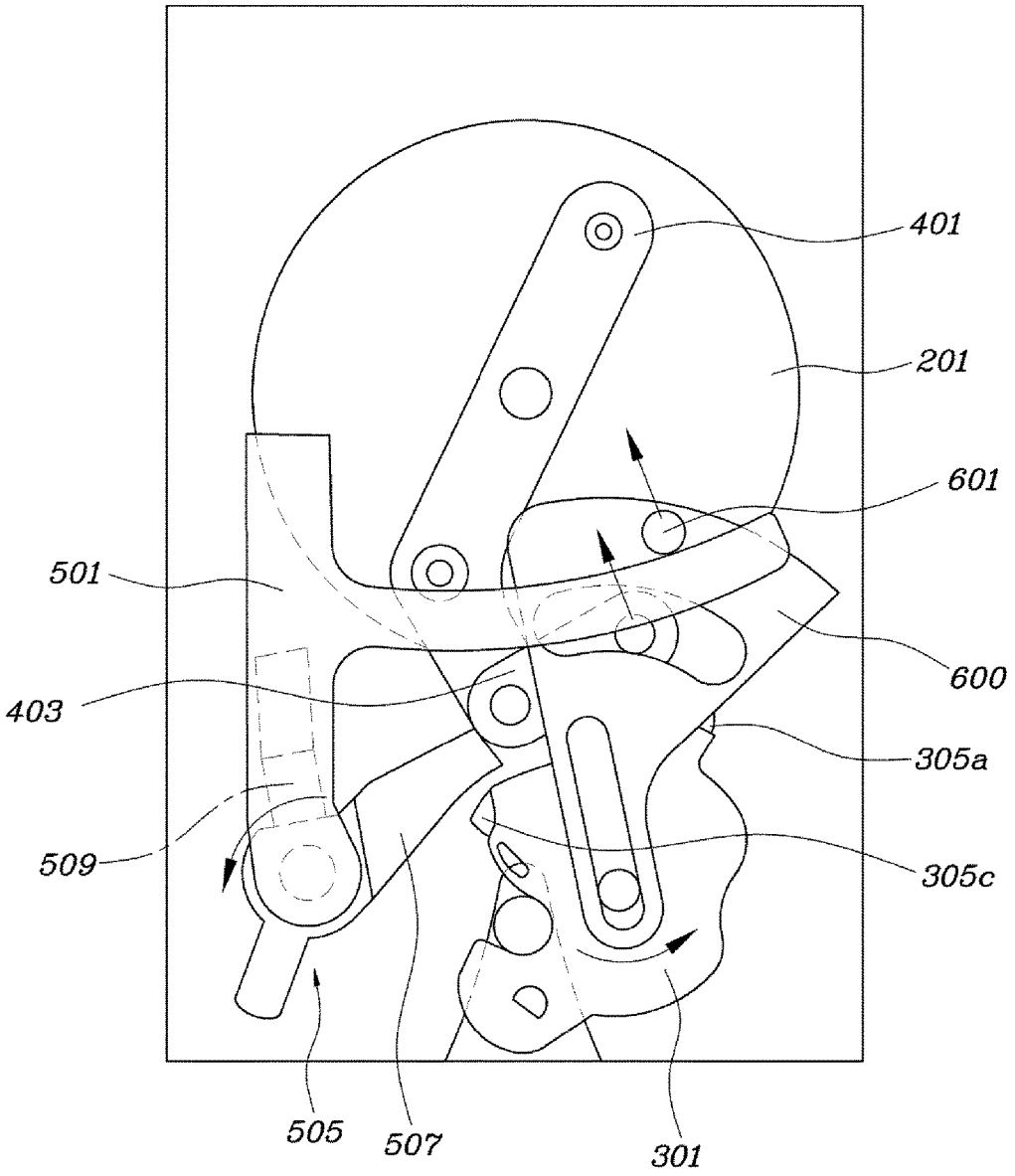

FIG. 1 is a top plan view of a trunk latch module for a vehicle according to various embodiments of the present invention. FIG. 2A, FIG. 2B and FIG. 2C are top plan views that show unlocking operation processes of the trunk latch module for a vehicle according to various embodiments of the present invention. FIG. 3A, FIG. 3B and FIG. 3C are top plan views that show locking operation processes of the trunk latch module for a vehicle according to various embodiments of the present invention. FIG. 4A and FIG. 4B are top plan views showing operation processes of an emergency unlock function of the trunk latch module for a vehicle according to various embodiments of the present invention.

The trunk latch module for a vehicle according to various embodiments of the present invention includes a base plate 100, a first locking groove 103 formed by being depressed from a lower end of the base plate 100 toward a middle part thereof such that a striker 101 is inserted into the first locking groove 103, a main gear 201 rotatably combined with the base plate 100 at a location above the first locking groove 103, the main gear being supplied with power from a motor, a claw 301 rotatably combined with the base plate 100 at a middle part thereof on one side of the first locking groove 103 relative to the first locking groove 103, with a second locking groove 303 provided at a first end of the claw 301 by being depressed toward the middle part of the claw 301 so as to correspond to an entering position of the striker 101, and with a stop protrusion assembly 305 provided on an outer surface of a second end part of the claw 301, a link assembly 400 combined with the main gear 201, the link assembly 400 transmitting power to the claw 301 by operating in conjunction with rotation of the main gear 201, a claw-kicking assembly 500 locking or releasing the claw 301 by using power transmitted from the link assembly 400, and a guide lever 600 guiding rotation directions of the link assembly 400 and the claw-locking assembly 500, wherein as the main gear 201 rotates in a first direction by the power of the motor, the link assembly 400 and the claw-locking assembly 500 are stopped by the stop protrusion assembly 305 of the claw, thereby locking the claw 301, whereas as the main gear 201 rotates in a second direction, the link assembly 400 and the claw-locking assembly 500 are released from the stop protrusion assembly 305, thereby unlocking the claw 301. The motor may be combined with the main gear 201 by using a worm and a worm gear so as to transmit the power.

Referring to FIG. 1, the trunk latch module for a vehicle according to various embodiments of the present invention includes the main gear 201 for increasing power of the motor via the worm and the worm gear, the link assembly 400 for turning a predetermined rotational movement of the main gear 201 into a linear movement or another rotational movement; the claw 301 for locking the striker 101, the claw-locking assembly 500 for securing a locked state of the claw 301, and the guide lever 600 for adjusting relative movements of the link assembly 400 and the claw-locking assembly 500.

According to various embodiments, the stop protrusion assembly 305 of the claw 301 may include a first stop protrusion 305*a*, a second stop protrusion 305*b*, and a third stop protrusion 305*c*.

Referring to FIG. 1, the first stop protrusion 305*a* allows the claw 301 to rotate until the claw 301 reaches a desired position so as to second-lock the striker 101. The second stop protrusion 305*b* functions to secure a first-level locked state, and the third stop protrusion 305*c* functions to secure a second-level locked state.

The link assembly 400 may include a first link 401 mounted to the main gear 201 while crossing the main gear 201, the first link 401 operating in conjunction with the main gear 201 during the rotation of the main gear 201; and a second link 403 hinged to a second end of the first link 401 at a first end thereof, with a slit protrusion 405 provided at a second end of the second link 403.

The first link 401 is combined with the main gear 201, and rotates during rotation of the main gear 201. The second end of the first link 401 is outside an outer surface of the main gear 201 by protruding therefrom, and the first link 401 is bent from the outer surface of the main gear 201, and is connected to the second link 403. The second link 403 is connected to the first link 401 at the first end thereof, and is provided with the slit protrusion 405 at the second end thereof so as to operate in conjunction with the guide lever 600. Particularly, a hinge connection part of the first link 401 and the second link 403 transmits power to a cancel lever 501 by pushing the cancel lever 501 while coming into contact with the cancel lever 501, thereby rotating the cancel lever 501.

The second end of the second link 403 transmits a rotational force transmitted from the first link 401 to the guide lever 600 using the slit protrusion 405, and performs linear movements by moving along a first slit hole 603 of the guide lever 600 described hereinafter.

The claw-locking assembly 500 may include: the cancel lever 501 rotatably combined with the base plate 100 at a first end thereof at a first side of the first locking groove 103, with an extension part 503 extending by protruding from a middle part of the cancel lever 501 toward a second side of the first locking groove 103; and a pawl lever 505 including a first lever 507 being in contact with the claw 301 and a second lever 509 being in contact with the link assembly 400, and moving in conjunction with the cancel lever 501 with a connection part of the first lever 507 and the second lever 509 coupled to be rotatable coaxially with the cancel lever 501.

The cancel lever 501 transmits the rotational force transmitted from the main gear 201 and the link assembly 400 to the claw 301 via the pawl lever 505.

The pawl lever 505 shares the rotation shaft with the cancel lever 501, and rotates the claw 301 by pushing the claw 301 using the rotational force transmitted from the cancel lever 501, and after the claw 301 is rotated, functions to secure the rotated state of the claw 301.

The cancel lever 501 may be rotated counterclockwise by a force applied to a second end of the cancel lever 501 so as to release the pawl lever 505 from the third stop protrusion 305*c*, so that the emergency unlock function is performed.

The cancel lever 501 plays an essential role in performing the emergency unlock function by which the cancel lever 501 can manually release a locked state of a trunk in an emergency situation.

Referring to FIG. 4A and FIG. 4B, the cancel lever 501 is rotated counterclockwise by the force applied to the second end of the cancel lever 501, thereby allowing the emergency unlock function to be performed. The cancel lever 501 is rotated counterclockwise by the force applied to the second end of the cancel lever 501, and the pawl lever 505 is rotated counterclockwise, and accordingly since the pawl lever 505 securing the rotated state of the claw 301 is released, the claw 301 is opened so as to release the striker 101 from the claw.

The guide lever 600 may be provided at a first end part thereof with a guide protrusion 601 configured to move along the extension part 503 of the cancel lever 501, and may be provided at a middle thereof with the first slit hole 603 into which the slit protrusion 405 of the second link 403 is inserted to guide a moving direction of the slit protrusion 405, and may be provided with a second slit hole 605 at a second end thereof, the second slit hole capable of moving along a rotation shaft of the claw 301 while the guide lever 600 rotates relative to the rotation shaft of the claw 301.

The guide lever 600 has a shape of a sector at a first end thereof, and is provided with the first slit hole 603 along an arc of the sector, and is provided with the second slit hole 605 in a radial direction of the arc of the sector at a second end thereof. The guide protrusion 601 is formed above the first slit hole 603, and moves along the extension part 503 of the cancel lever 501, and the slit protrusion 405 of the second link 403 is inserted into the first slit hole 603 and moves in the first slit hole 603, and the second slit hole 605 is configured to move along the rotation shaft of the claw 301. Accordingly, power is transmitted and movement relations are adjusted between the cancel lever 501, the second link 403, and the claw 301.

Referring to FIG. 3A, FIG. 3B and FIG. 3C, when the striker 101 is inserted into the first locking groove 103, the striker may rotate the claw 301 by pushing the third stop protrusion 305*c* of the claw 301, and the second locking groove 303 may block the first locking groove 103, thereby completing a first-level locking. When the first-level locking is completed, the second end of the second link 403 may be positioned to be stopped by the first stop protrusion 305*a* of the claw 301, and the pawl lever 505 may reach a position of the second stop protrusion 305*b*. When the main gear 201 rotates counterclockwise, the second end of the second link 403 may rotate the claw 301 clockwise by pushing the first stop protrusion 305*a* of the claw 301 until the pawl lever 505 is stopped by the third stop protrusion 305*c*, thereby completing a second-level locking.

In the related art, since in performing locking via the claw 301, a structure of a link in a trunk latch module was very complicated, power of a motor was not properly transmitted, and thus the trunk latch module failed to completely perform a mechanism of locking and unlocking, and was provided with a plurality of motors mounted in respective rotational directions. In this case, since the trunk latch module for a vehicle was difficult to package, it was difficult to be mounted to a vehicle body.

However, the trunk latch module for a vehicle according to various embodiments of the present invention locks and unlocks a trunk latch by use of a single motor, thereby reducing cost and size of the trunk latch module.

Particularly, the trunk latch module for a vehicle according to various embodiments of the present invention is configured to provide a rotational force counterclockwise via an elastic body such as a torsion spring at rotation center of the claw 301, and thus the claw 301 is configured to normally open the first locking groove 103.

The following description relates to a locking mechanism according to various embodiments of the present invention. While the striker 101 is inserted into the first locking groove 103, the striker 101 rotates the claw 301 clockwise, thereby entering a first-level locking. In this case, as a consequence of relative movements of the guide protrusion 601, the first slit hole 603, and the second slit hole 605 of the guide lever 600, the second end of the second link 403 reaches a position of the first stop protrusion 305*a* of the claw 301, and the pawl lever 505 reaches the position of the second stop protrusion 305*b*. Accordingly, the first-level locking is performed.

In this case, when the main gear 201 continues to rotate counterclockwise, the second end of the second link 403 moves along the first slit hole 603 of the guide lever 600, and pushes the first stop protrusion 305*a* of the claw 301, which rotates the claw 301 clockwise. As the claw 301 rotates clockwise, the first locking groove 103 is completely closed by the claw 301, and the pawl lever 505 is released from the second stop protrusion 305*b*, and reaches a position of the third stop protrusion 305*c*, and thereby second-level locking is performed.

Referring to FIG. 2A, FIG. 2B and FIG. 2C, when the main gear 201 rotates clockwise, the hinge connection part of the first link 401 and the second link 403 rotates the cancel lever 501 counterclockwise, and the pawl lever 505 rotates counterclockwise in conjunction with the counterclockwise rotation of the cancel lever 501, and is released from the third stop protrusion 305*c*, thereby unlocking the claw.

A force is normally applied to the claw 301 by the torsion spring in a direction opening the first locking groove 103. Accordingly, when the pawl lever 505 for stopping the rotation of the claw 301 is released, the claw 301 is unlocked. In this case, the main gear 201 rotates clockwise, the hinge connection part of the first link 401 and the second link 403 rotates the cancel lever 501 counterclockwise by pushing the cancel lever 501, and the pawl lever 505 also rotates counterclockwise in conjunction with the counterclockwise rotation of the cancel lever 501, thereby unlocking the claw 301.

According to various embodiments, the trunk latch module may further include a controller, that detects the first-level locked state by using a first sensor 701 mounted to the cancel lever 501, rotates the main gear 201 counterclockwise by controlling an operation of the motor, detects the completion of the second-level locking by using a second sensor 703 provided on the base plate 100 at a position adjacent to the claw 301, and rotates the main gear 201 clockwise by using a third sensor 705 provided on an upper end of the main gear 201, thereby allowing the second end of the second link 403 to reach the position of the second stop protrusion 305*b* of the claw 301.

Referring to FIG. 1, when a trunk is not locked by a force of a user of a vehicle, the trunk latch module allows the first sensor 701, the second sensor 703, and the third sensor 705 to detect the unlocked state, and to additionally drive the motor, thereby realizing the second-level locking.

The pawl lever 505 further includes a third lever 511 extending from an end of the second lever 509 and bending opposite to the extension part 503 of the cancel lever 501. When the main gear 201 rotates counterclockwise, the hinge connection part of the first link 401 and the second link 403 rotates the cancel lever 501 counterclockwise by pressing down the third lever 511, and the pawl lever 505 rotates counterclockwise in conjunction with the counterclockwise rotation of the cancel lever 501 and is released from the third stop protrusion 305*c*, thereby unlocking the claw.

As described above, it is possible to unlock the claw 301 by rotating the main gear 201 clockwise, but more simply, it is possible to unlock the claw by additionally providing the third lever 511 to the pawl lever 505.

Figure 5A:
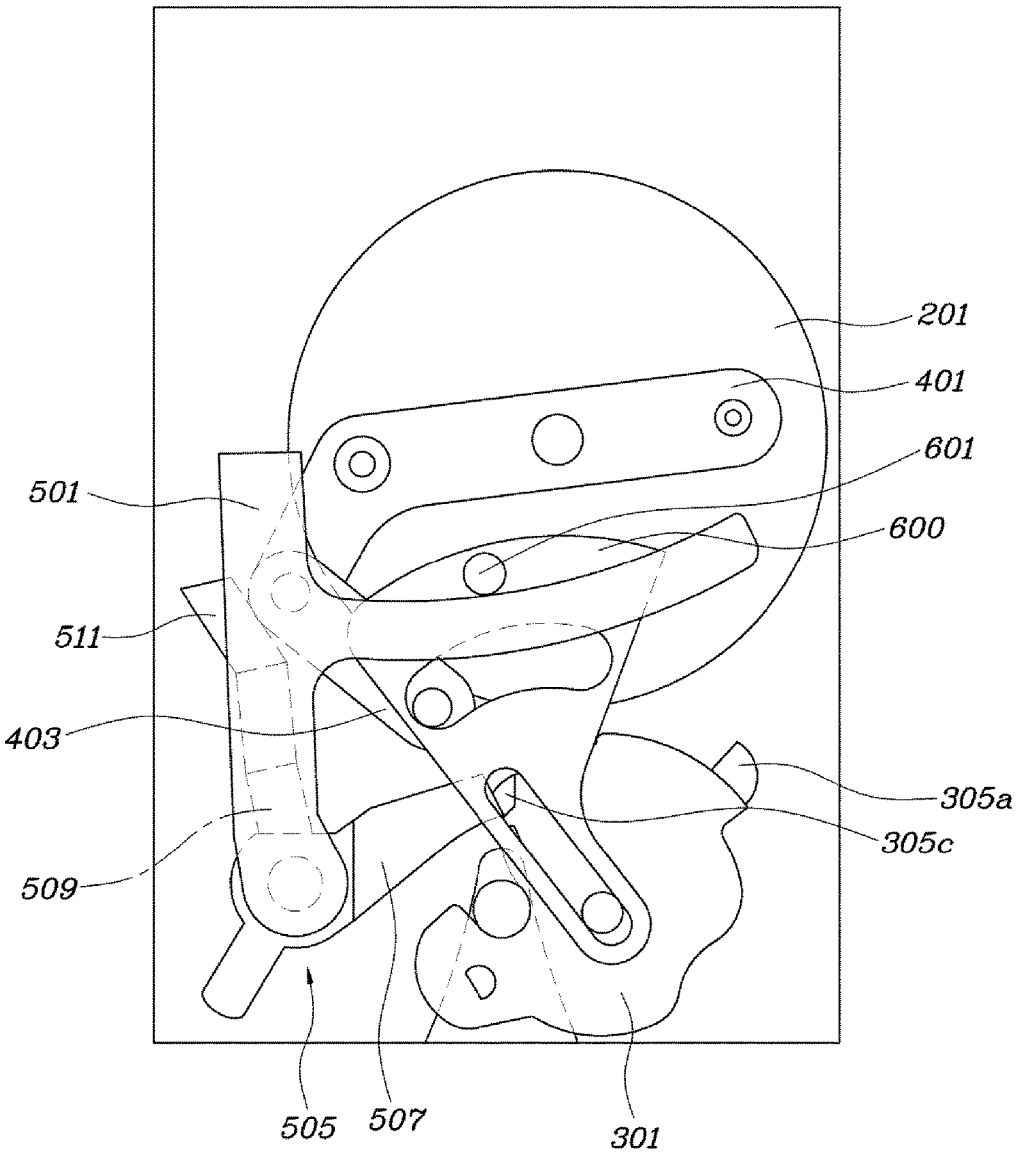
FIG. 5A and FIG. 5B are top plan views showing unlocking processes of the trunk latch module for a vehicle according to other various embodiments of the present invention.
Figure 5B:
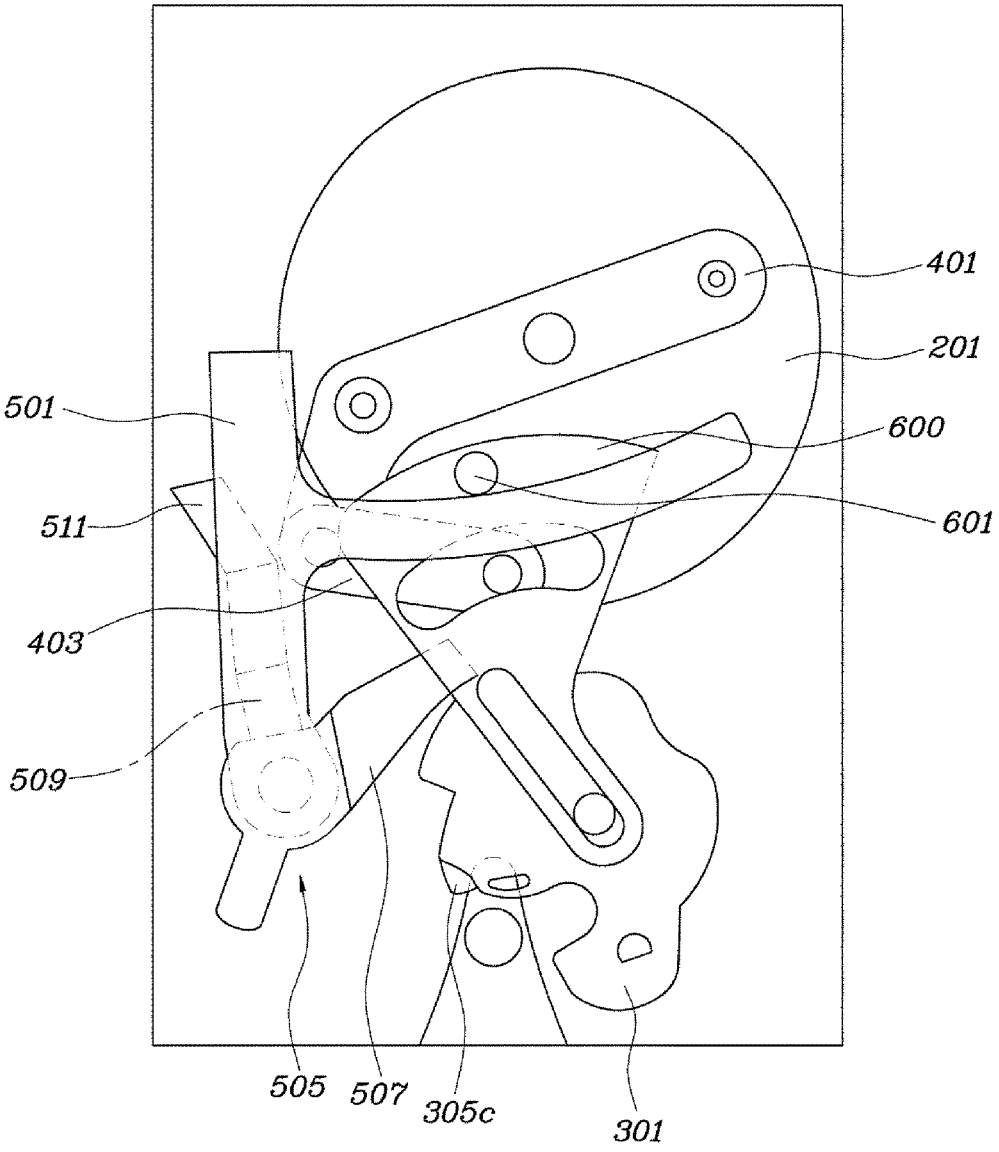

Referring to FIGS. 5A and 5B, the main gear 201 rotates counterclockwise, the hinge connection part of the first link 401 and the second link 403 rotates the cancel lever 501 counterclockwise by pressing down the third lever 511, and the pawl lever 505 correspondingly rotates counterclockwise, thereby unlocking the claw 301.

For convenience in explanation and accurate definition in the appended claims, the terms "upper" or "lower", "inner" or "outer" and etc. are used to describe features of the exemplary embodiments with reference to the positions of such features as displayed in the figures.

The foregoing descriptions of specific exemplary embodiments of the present invention have been presented for purposes of illustration and description. They are not intended to be exhaustive or to limit the invention to the precise forms disclosed, and obviously many modifications and variations are possible in light of the above teachings. The exemplary embodiments were chosen and described in order to explain certain principles of the invention and their practical application, to thereby enable others skilled in the art to make and utilize various exemplary embodiments of the present invention, as well as various alternatives and modifications thereof. It is intended that the scope of the invention be defined by the Claims appended hereto and their equivalents.

What is claimed is:

1. A trunk latch module for a vehicle, the trunk latch module comprising:

a base plate;

a first locking groove formed by being depressed from a lower end of the base plate toward a middle of the base plate for insertion of a striker into the first locking groove;

a main gear rotatably combined with the base plate at a position above the first locking groove, the main gear being supplied with power of a motor;

a claw rotatably combined with the base plate at a middle thereof on a first side of the first locking groove, with a second locking groove provided at a first end of the claw by being depressed toward the middle of the claw to correspond to an entering position of the striker, and with a stop protrusion assembly provided on an outer surface of a second end of the claw;

a link assembly rotatably combined with the main gear, the link assembly transmitting the power of the motor to the claw by operating in conjunction with rotation of the main gear;

a rotatable claw-locking assembly locking or releasing the claw by using the power of the motor transmitted from the link assembly; and a rotatable guide lever guiding rotation directions of the link assembly and the rotatable claw-locking assembly, wherein as the main gear rotates in a first direction by the power of the motor, the link assembly and the rotatable claw-locking assembly are engaged by the stop protrusion assembly of the claw, thereby locking the claw, and as the main gear rotates in a second direction, the link assembly and the rotatable claw-locking assembly are released from engagement with the stop protrusion assembly, thereby releasing the claw, and wherein the rotatable claw-locking assembly comprises:

a cancel lever rotatably combined with the base plate at a first end of the cancel lever at a second side of the first locking groove, with an extension part extending by protruding from a middle of the cancel lever toward the first side of the first locking groove; and a pawl lever including a first lever configured for contact with the claw and a second lever configured for contact with the link assembly and moving in conjunction the cancel lever, and a connection part of the first lever and the second lever coupled to be rotatable coaxially with the cancel lever.

2. The trunk latch module of claim 1, wherein the stop protrusion assembly of the claw includes a first stop protrusion, a second stop protrusion, and a third stop protrusion.

3. The trunk latch module of claim 2, wherein the link assembly comprises:

a first link mounted to the main gear so as to cross the main gear, the first link operating in conjunction with the main gear during the rotation of the main gear in the firt and second directions; and a second link hinged to a second end of the first link at a first end of the second link, with a slit protrusion provided at a second end of the second link creating a hinge connection part.

4. The trunk latch module of claim 3, wherein the rotatable guide lever is provided at a first end thereof with a guide protrusion configured to move along the extension part of the cancel lever, and is provided at a middle thereof with a first slit hole into which the slit protrusion of the second link is inserted to guide a moving direction of the slit protrusion, and is provided with a second slit hole at a second end of the rotatable guide lever, the second slit hole configured for moving along a rotation shaft of the claw while the rotatable guide lever rotates relative to the rotation shaft of the claw.

5. The trunk latch module of claim 4, wherein when the striker is inserted into the first locking groove, the striker rotates the claw by pushing the third stop protrusion of the claw, and the second locking groove blocks the first locking groove, to complete a first-level locking of the claw.

6. The trunk latch module of claim 5, wherein when the first-level locking is completed, the second end of the second link is positioned to be engaged by the first stop protrusion, and the pawl lever reaches a position of the second stop protrusion.

7. The trunk latch module of claim 6, wherein the first direction of the rotation of the main gear is a counterclockwise direction and the second direction of rotation of the main gear is a clockwise direction, and wherein when the main gear rotates in the counterclockwise direction, the second end of the second link rotates the claw clockwise by pushing the first stop protrusion of the claw until the pawl lever is stopped by the third stop protrusion, thereby completing a second-level locking of the claw.

8. The trunk latch module of claim 7, further comprising a controller to detect the first-level locking of the claw by using a first sensor mounted to the cancel lever, to rotate the main gear in the counterclockwise direction by controlling an operation of the motor, to detect the completion of the second-level locking of the claw by using a second sensor provided on the base plate at a position adjacent to the claw, and to rotate the main gear in the clockwise direction by using a third sensor provided on an upper end of the main gear, allowing the second end of the second link to reach a position corresponding to the second stop protrusion of the claw.

9. The trunk latch module of claim 7, wherein the cancel lever is rotated counterclockwise by a force applied to a second end of the cancel lever to release the pawl lever from engagement with the third stop protrusion, so that an emergency unlock function is performed.

10. The trunk latch module of claim 4, wherein the second direction of rotation of the main gear is a clockwise direction, and when the main gear rotates in the clockwise direction, the hinge connection part of the first link and the second link rotates the cancel lever counterclockwise, and the pawl lever rotates counterclockwise in conjunction with a counterclockwise rotation of the cancel lever, and is released from engagement with the third stop protrusion, thereby releasing the claw.

11. The trunk latch module of claim 4, wherein the pawl lever further includes a third lever extending from an end of the second lever and bending opposite to the extension part of the cancel lever, wherein the second direction of rotation of the main gear is a clockwise direction, and wherein when the main gear rotates in the clockwise direction, the hinge connection part of the first link and the second link rotates the cancel lever counterclockwise by pressing down the third lever, and the pawl lever rotates counterclockwise in conjunction with a counterclockwise rotation of the cancel lever and is released from engagement with the third stop protrusion, thereby releasing the claw.

* * * * *